US007189129B2

(12) United States Patent
DeMange

(10) Patent No.: US 7,189,129 B2
(45) Date of Patent: Mar. 13, 2007

(54) LIFE SAVER BUOY

(76) Inventor: Craig DeMange, 1031 Logan Blvd., Naples, FL (US) 34116

( * ) Notice: Subject to any disclaimer, the term of this patent is extended or adjusted under 35 U.S.C. 154(b) by 0 days.

(21) Appl. No.: 11/035,482

(22) Filed: Jan. 18, 2005

(65) Prior Publication Data

US 2006/0160443 A1 Jul. 20, 2006

(51) Int. Cl.
*B63C 9/26* (2006.01)
*B63C 9/08* (2006.01)

(52) U.S. Cl. ..... 441/81; 441/84

(58) Field of Classification Search ..... 441/80–85
See application file for complete search history.

(56) References Cited

U.S. PATENT DOCUMENTS 5,458,515 A * 10/1995 Busetti ..... 441/81
5,562,512 A * 10/1996 Samelian ..... 441/81
6,629,867 B1 * 10/2003 Smith ..... 441/81
D493,922 S * 8/2004 Klotz ..... D29/124

FOREIGN PATENT DOCUMENTS

CA 1225545 A * 8/1987
CA 1271093 A * 7/1990
DE 19601129 A1 * 7/1997

* cited by examiner

*Primary Examiner*—Ajay Vasudeva

(57) ABSTRACT

A life saver buoy comprising a life line attached to a ring-shaped buoyant body, the buoyant body having a central aperture and a peripheral groove formed in an outer periphery of the body for winding the line therearound. The line extends through a radial bore in the buoyant body, wherein a first proximal end of the line is coupled to the body and a second distal end of the line comprises a handle. A strap is provided for fastening, the second distal end of the line and the handle to the buoyant body.

6 Claims, 2 Drawing Sheets

LIFE SAVER BUOY

BACKGROUND OF THE INVENTION

Life savers buoys are well known items in the aquatic environment. They are required items on boats and ships and are coded and controlled by the Coast Guard. They are required items at swimming pools and are coded and controlled by local authorities such as a county or a city.

The known buoys consist of a ring made of floatable material that can support an average sized adult. They have a center opening large enough so that a head of a person can protrude there through. At the center hole or on the outer periphery of the ring, there are gripping ropes attached so that they can be gripped by a person or several persons with the ring providing flotation. The Coast Guard also requires that a long life line be attached to the ring so that the life saver buoy can be retrieved and hauled back whenever a buoy has been tossed to a person in need of rescue or once it hit its target, a helpless person can be pulled to safety. The Coast Guard requires this line to be at least 50'(feet) long. This line, in most instances creates a problem because it cannot be tied into a bundle and stored because in an emergency, the line does not untangle easily and may not reach its intended target. Therefore, most lines lie around in a tangled heap or are stored or wound around a hook close to the buoy and in most instances is very unsightly and again may not serve its intended purpose.

BRIEF SUMMARY OF THE INVENTION

The inventive buoy solves the above noted problems by simply winding the life line around a periphery of the buoy in an orderly fashion and will easily unwind therefrom when tossed or thrown in an emergency without ever getting tangled up. This fact greatly contributes to the safety and the enjoyment of water activities while swimming or boating.

DETAILED DESCRIPTION OF THE INVENTION

Figure 1:
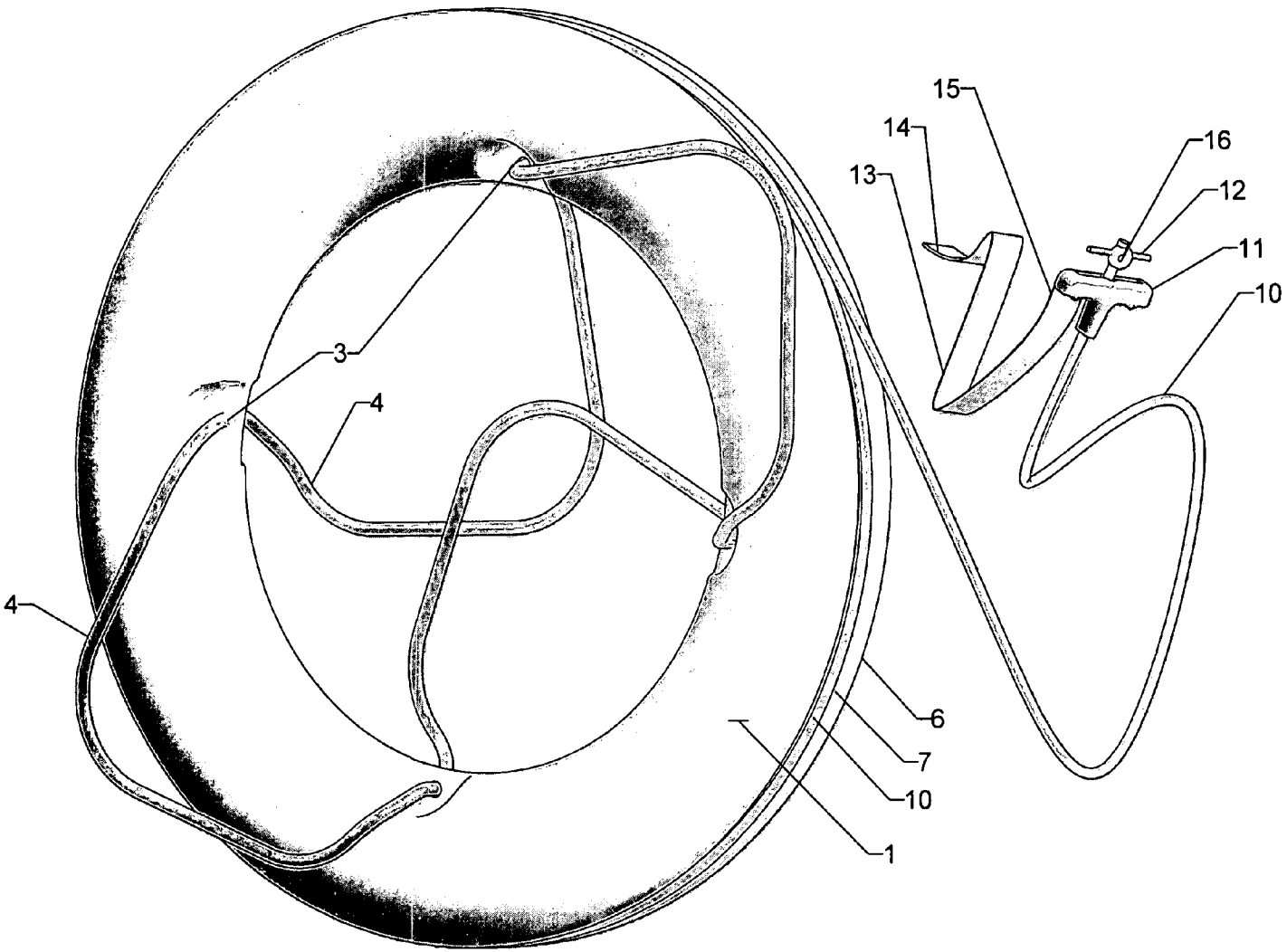
FIG. 1 is a perspective view of the life saving buoy.

FIG. 1 shows the top of the life saving buoy which is depicted at 1. As is well known, all life saving buoys have a center aperture or opening which in FIG. 1 is not shown. The inner periphery of the buoy has four equidistantly spaced depressions shown at 3. The depressions are used for placing a gripping rope 4 in their holes which are to be gripped be a person or persons in an emergency. As can be seen, the gripping ropes have some slack in themselves so that they can be safely gripped and handled. The outer periphery of the buoy 1 is indicated at 6. The outer periphery 6 has an inwardly directed V-shaped groove 7 therein (more clearly shown in FIG. 2). There is an inwardly directed bore 8 through the buoy which is enlarged at 9 at the inner periphery.

Figure 2:
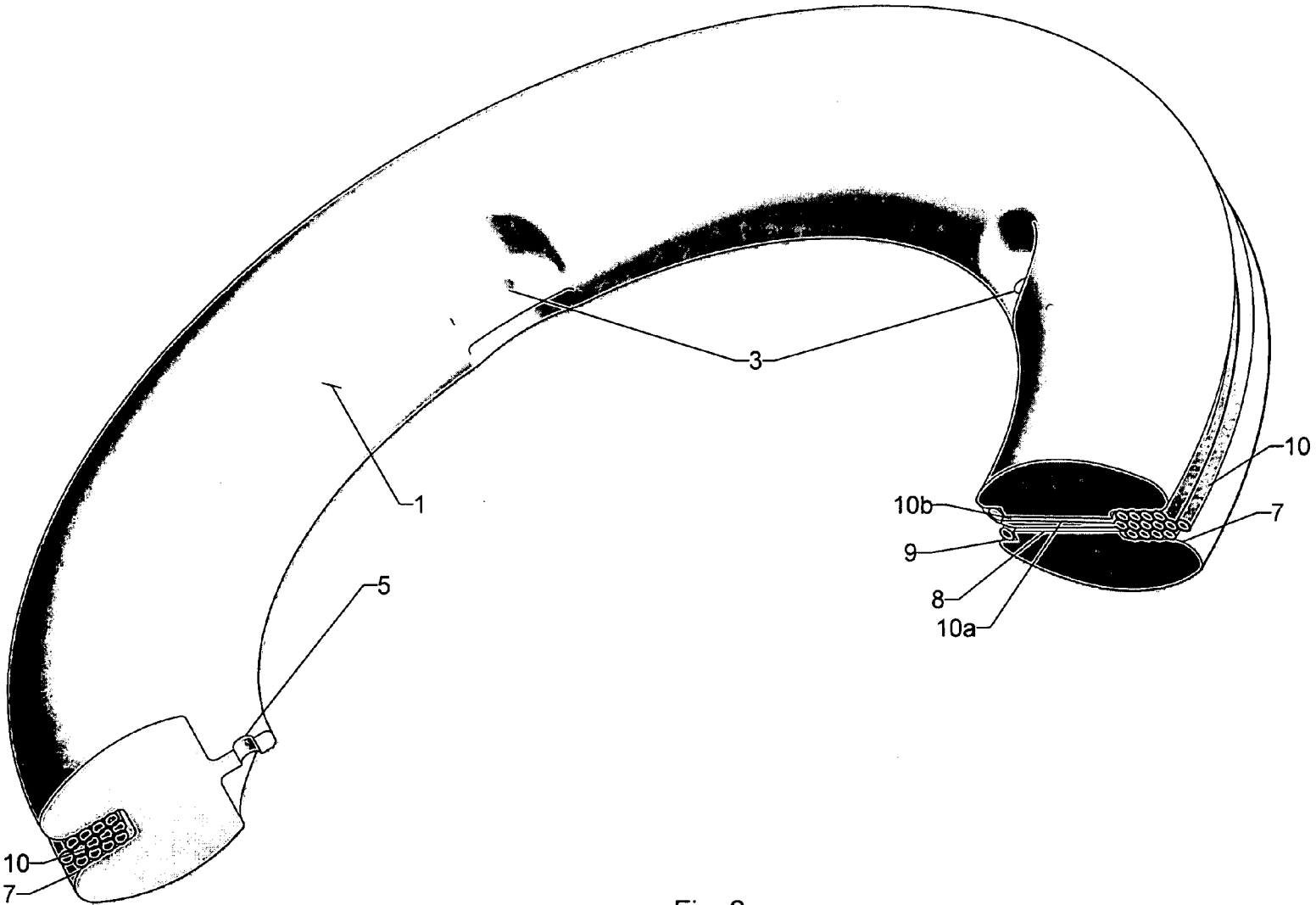
FIG. 2 is a cross sectional and perspective view of the buoy of FIG. 1.

FIG. 2 shows the buoy 1 in a cross section and the inwardly directed groove 7 can clearly be seen. As explained above, the groove 7 will receive the life line 10 therein when it is wound therein in multiple turns. The depth of the groove

7 is such that it can accommodate a length of the life line of about 90'(feet). The inner end 10*a* of the life line 10 is attached to the buoy by passing the end through the bore 8 and tying a knot 10*b* therein which will be seated in the enlargement 9 so that it cannot interfere with any activity involving the buoy. The other end of the life line 10 receives a handle 11 (FIG. 1). The handle is shown as a box 11 with the knot 16 therein and a cover plate 12 covers the box. As is well known, the handle stays with the person who threw the buoy. When not in use and in storage, the handle 11 is tied around the circumference of the buoy and fastened there around by of a strap 13. The strap 13 has at an outer end 14 thereof one part of the loop and hook fastening system, known as VELCRO, and at the inner end 15 has the other part of the hook and loop fastener. The two parts 14 and 15 are used to fasten the handle tightly against the outer circumference of the buoy and it is a very simple matter of undoing the ends of the strap 13 in case of an emergency without having to fumble with any knots or other entanglements.

The invention claimed is:

1. A personal flotation device adapted to support a person in water, the flotation device comprising:

a ring shaped buoyant body having an outer periphery and a central aperture, the body comprising symmetrical upper and lower annular sections separated by a radial plane of symmetry, and an annular groove formed in the outer periphery of the body, wherein the groove extends inwardly along the radial plane of symmetry from the periphery toward the central aperture, the groove extending along the entire circumference of the buoyant body;

a life line having first and second ends, the first end coupled to the buoyant body and the second end being free and adapted to be held by a person;

wherein the groove is sized to form a receptacle for accommodating the life line when the life line is wound around the buoyant body; and wherein at least one of the upper and lower annular sections has an arcuate surface extending from an inner diameter to an outer diameter of the body.

2. The personal flotation device of claim 1 including at least one radial bore extending along the radial plane of symmetry from the annular groove toward the central aperture, said bore having a first section proximate the central aperture and a second section proximate the groove, the first section having a diameter that is larger than a diameter of the second section.

3. The personal flotation device of claim 2, wherein a section of the life line proximate the first end passes through the bore, the life line comprising a knot at substantially the first end, the knot being accommodated in the first section of the bore.

4. The personal flotation device of claim 1, comprising a handle attached at substantially the second end of the life line.

5. The personal flotation device of claim 4, comprising a strap for fastening the second end of the line and the handle around and against the buoyant body.

6. The personal flotation device of claim 5, wherein ends of the strap comprise hook and loop fasteners for fastening the strap ends to each other.

* * * * *